US011231670B2

(12) United States Patent
Okuzawa

(10) Patent No.: US 11,231,670 B2
(45) Date of Patent: Jan. 25, 2022

(54) IMAGE FORMING APPARATUS AND STORAGE MEDIUM STORING CONTROL PROGRAM FOR IMAGE FORMING APPARATUS

(71) Applicant: Konica Minolta, Inc., Tokyo (JP)

(72) Inventor: Sho Okuzawa, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 90 days.

(21) Appl. No.: 16/718,620

(22) Filed: Dec. 18, 2019

(65) Prior Publication Data

US 2020/0201224 A1 Jun. 25, 2020

(30) Foreign Application Priority Data

Dec. 19, 2018 (JP) ..... JP2018-237613

(51) Int. Cl.
*G03G 15/00* (2006.01)

(52) U.S. Cl.
CPC ..... *G03G 15/5008* (2013.01); *G03G 15/652* (2013.01); *G03G 15/6529* (2013.01)

(58) Field of Classification Search
CPC ..... G03G 15/6564; G03G 15/234; G03G 15/6567; G03G 15/2028
See application file for complete search history.

(56) References Cited

U.S. PATENT DOCUMENTS

2016/0202648 A1* 7/2016 Takada ..... G03G 15/5029 399/67
2016/0370740 A1* 12/2016 Kobayashi ..... G03G 15/652
2017/0075261 A1* 3/2017 Takatsuka ..... G03G 15/6517
2018/0032019 A1* 2/2018 Hayashi ..... G03G 15/6529

FOREIGN PATENT DOCUMENTS

JP 2007015828 A 1/2007

* cited by examiner

*Primary Examiner* — Walter L Lindsay, Jr.
*Assistant Examiner* — Jessica L Eley
(74) *Attorney, Agent, or Firm* — Cantor Colburn LLP

(57) ABSTRACT

An image forming apparatus according to the present invention includes a first conveyance member, a second conveyance member, and a controller. The first conveyance member and the second conveyance member convey a continuous sheet. The controller determines whether a second conveyance speed which is a conveyance speed of the continuous sheet conveyed by the first conveyance member and the second conveyance member can be detected normally on the basis of a first conveyance speed which is a conveyance speed of the continuous sheet conveyed by the first conveyance member.

15 Claims, 4 Drawing Sheets

IMAGE FORMING APPARATUS AND STORAGE MEDIUM STORING CONTROL PROGRAM FOR IMAGE FORMING APPARATUS

CROSS-REFERENCE TO RELATED APPLICATION

The present invention claims priority under 35 U.S.C. § 119 to Japanese patent application No. 2018-237613 filed on Dec. 19, 2018, the entire contents of which are incorporated herein by reference.

BACKGROUND

1. Technological Field

The present invention relates to an image forming apparatus and a storage medium storing a control program for the image forming apparatus.

2. Description of the Related Art

In an image forming apparatus, there is a known technique for keep a conveyance speed of a continuous sheet constant in order to stably print an image on the continuous sheet. For example, Unexamined Japanese Patent Publication 2007-15828 discloses an image forming apparatus that measures the conveyance speed of a continuous sheet and controls the conveyance speed to be a reference speed.

SUMMARY

However, in the image forming apparatus disclosed in Unexamined Japanese Patent Publication 2007-15828 has not assumed that there might be a case that the conveyance speed of the continuous sheet cannot be detected normally depending on a surface state of the continuous sheet, for example. For example, when a contact sensor including a rotary encoder 382 or the like is used, there might be a case where the conveyance speed of a continuous sheet having a low friction coefficient or a continuous sheet having unevenness on surface irregularities cannot be detected normally. In addition, when a non-contact sensor such as a laser Doppler sensor is used, there is a case where the conveyance speed of a continuous sheet having gloss cannot be detected normally. The image forming apparatus disclosed in Unexamined Japanese Patent Publication 2007-15828 has not assumed the possibility of occurrence of such a case, and thus, there is a concern that feedback control might be performed in a state where the conveyance speed of the continuous sheet is not normally detected, leading to a print failure.

In addition, even when the image forming apparatus determines whether the conveyance speed of the continuous sheet can be normally detected, there remains a problem that, in a case determination that the conveyance speed of the continuous sheet cannot be detected is made during printing, a waste of printing such as a waste of the continuous sheet conveyed before determination and a waste of consumed toner would occur. Furthermore, even when the image forming apparatus makes the abovementioned determination before the start of printing, the continuous sheet need to be conveyed without forming an image on the continuous sheet (non-print conveyance) to detect the conveyance speed of the continuous sheet. Therefore, there is still a problem that waste of continuous sheet is not suppressed.

The present invention has been made in view of the abovementioned problems. Accordingly, an object of the present invention is to provide an image forming apparatus and a storage medium storing a control program for the image forming apparatus that determine, at an appropriate timing, whether the conveyance speed during printing of the continuous sheet can be normally detected.

To achieve at least one of the abovementioned objects, according to an aspect of the present invention, an image forming apparatus and a storage medium storing control program for the image forming apparatus comprise followings.

The image forming apparatus comprises a first conveyance member and a second conveyance member that convey a continuous sheet; and a controller that determines whether it is possible to normally detect a second conveyance speed which is a conveyance speed of said continuous sheet conveyed by said first conveyance member and said second conveyance member on the basis of a first conveyance speed which is a conveyance speed of said continuous sheet conveyed by said first conveyance member.

The storage medium storing control program for an image forming apparatus including a first conveyance member and a second conveyance member which convey a continuous sheet, the control program causing a computer to perform: detecting a first conveyance speed which is a conveyance speed of said continuous sheet conveyed by said first conveyance member; and determining whether a second conveyance speed which is a conveyance speed of said continuous sheet conveyed by said first conveyance member and said second conveyance member can be normally detected on the basis of said first conveyance speed.

The objects, features, and characteristics of this invention other than those set forth above will become apparent from the description given herein below with reference to preferred embodiments illustrated in the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
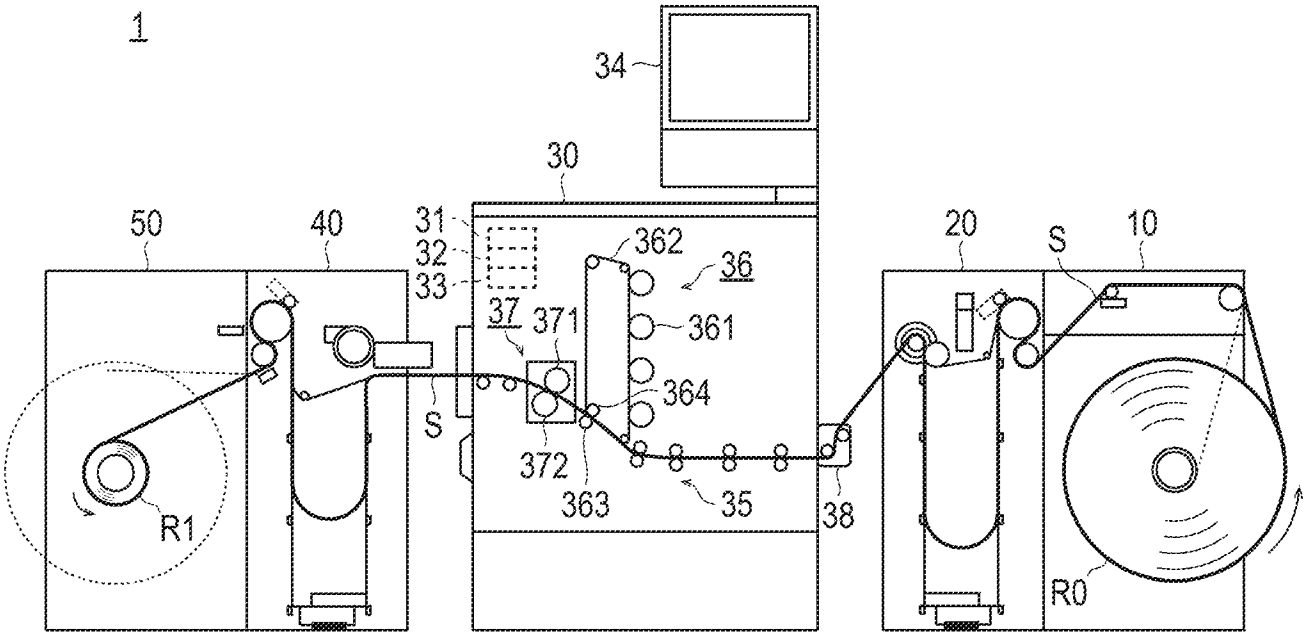
FIG. 1 is a diagram illustrating a schematic configuration of an image forming system according to an embodiment of the present invention.

Hereinafter, one or more embodiments of the present invention will be described with reference to the drawings. However, the scope of the invention is not limited to the disclosed embodiments.

Note that, in the description of the drawings, the same elements are denoted by the same reference numerals, and redundant description is omitted. In addition, there might be a case where the dimensional ratios in the drawings are exaggerated for convenience of explanation, and differ from actual ratios.

FIG. 1 is a diagram illustrating a schematic configuration of an image forming system according to an embodiment of the present invention.

As illustrated in FIG. 1, the image forming system 1 includes a sheet feeder 10, a sheet feed adjustment device 20, an image forming apparatus 30, a sheet discharge adjustment device 40, and a winding device 50. These devices are connected in order from the upstream side to the downstream side in the conveyance direction of a continuous sheet S used as the sheet.

The sheet feeder 10 stores and holds a sheet roll R0 as the continuous sheet S wound in a roll shape, and supplies the continuous sheet S in the conveyance direction of the continuous sheet S.

The sheet feed adjustment device 20 sags and holds the continuous sheet S and adjusts the supply of the continuous sheet S to the image forming apparatus 30. That is, the sheet feed adjustment device 20 has a buffer function for absorbing a minute difference in the conveyance speed of the continuous sheet S between the sheet feeder 10 and the image forming apparatus 30, a shift of the continuous sheet S, or the like.

The image forming apparatus 30 forms an image based on image data on the continuous sheet S using a known image forming process such as an electrophotographic process.

The sheet discharge adjustment device 40 sags and holds the continuous sheet S, and adjusts the supply of the continuous sheet S to the winding device 50. Similarly to the sheet feed adjustment device 20, the sheet discharge adjustment device 40 has a buffer function of absorbing the minute difference in the conveyance speed of the continuous sheet S between the image forming apparatus 30 and the winding device 50, the shift of the continuous sheet S, or the like.

The winding device 50 winds the discharged continuous sheet S in a roll shape to form the sheet roll R1.

Hereinafter, a case where a sheet roll is used as the continuous sheet S will be described as an example. However, the continuous sheet S is not limited to the sheet roll, and may be a fan-hold sheet, for example. In addition, the material of the continuous sheet S is not limited to sheet, and may be cloth, film, or the like, for example. In addition, the continuous sheet S may be a label sheet formed by sticking a label coated with an adhesive to release sheet.

Next, details of the image forming apparatus 30 will be described.

As illustrated in FIG. 1, the image forming apparatus 30 includes a controller 31, a storage 32, a communicator 33, an operation panel 34, a conveyor 35, an image former 36, a fixer 37, and a detector 38. Each of components is connected to each other via a bus for exchanging signals.

The controller 31 includes a CPU (Central Processing Unit), and performs control of each of components described above and various types of arithmetic processing in accordance with a program. For example, the controller 31 communicates and cooperates with the controllers of the sheet feeder 10, the sheet feed adjustment device 20, the sheet discharge adjustment device 40, and the winding device 50, and thereby controls the conveyance of the continuous sheet S The storage 32 includes a ROM (Read Only Memory) that stores various programs and various data in advance, a RAM (Random Access Memory) that temporarily stores programs and data as a work area, a hard disk that stores various programs and various data, and the like.

The communicator 33 includes an interface for communicating with other devices such as a user's PC (Personal Computer). For example, the communicator 33 receives a print job from the user's PC.

The operation panel 34 includes a touch panel, a numeric keypad, a start button, a stop button, and the like, and used to display various types of information as a display and receive various operations as an operation receiver.

The conveyor 35 includes a conveyance path, a plurality of conveyance rollers arranged along the conveyance path, and a driving motor (not illustrated) that drives the conveyance roller, and conveys the continuous sheet S along the conveyance path.

The image former 36 forms the image based on image data on the continuous sheet S conveyed by the conveyor 35. The image former 36 includes an image forming unit 361 for individual colors, an intermediate transfer belt 362, a transfer roller 363, a counter roller 364, and the like.

The image forming unit 361 of each of colors forms an image of toner of each of the colors. The intermediate transfer belt 362 is an endless belt supported by a plurality of rollers in a travelable manner, and conveys an image transferred by the image forming unit 361 in a primary transfer region to a secondary transfer region. The transfer roller 363 is disposed in the secondary transfer region, and forms a nip portion between the transfer roller 363 and the counter roller 364, the transfer roller 363 and the counter roller 364 being disposed so as to be opposed to each other with the intermediate transfer belt 362 interposed therebetween. Subsequently, the transfer roller 363 transfers the image conveyed by the intermediate transfer belt 362 onto the continuous sheet S passing through the nip portion. The transfer roller 363 is configured to be separable from the intermediate transfer belt 362 and the counter roller 364.

The fixer 37 includes a fixing roller 371 and a pressure roller 372, and heats and presses the continuous sheet S on which the image is formed by the image former 36, thereby fixing the image on the continuous sheet S. The fixing roller 371 is heated by an internally provided heater, an externally provided heating roller (not illustrated) or the like. The pressure roller 372 forms a nip portion between the pressure roller 372 and the opposing fixing roller 371, and the continuous sheet S passing through the nip portion is heated and pressurized. The fixing roller 371 may be configured to be separable from the pressure roller 372.

The pressure roller 372 and the transfer roller 363 are driven by a driving motor, thereby functioning as conveyance rollers that is included in the conveyor 35 and that conveys the continuous sheet S. Hereinafter, the pressure roller 372 is also referred to as a first conveyance member, and the transfer roller 363 is also referred to as a second conveyance member. That is, the first conveyance member 372 as a pressure roller is disposed in the fixer 37 on the downstream side of the second conveyance member 363 in the conveyance direction of the continuous sheet S. In addition, the second conveyance member 363 as a transfer roller is disposed in the secondary transfer region. Note that, in addition to the pressure roller 372 or instead of the pressure roller 372, the fixing roller 371 may function as the first conveyance member 372.

In the present embodiment, the first conveyance member 372 is assumed to have a conveyance capability higher than that of the second conveyance member 363 for the continuous sheet S. The conveyance of the continuous sheet S is started by the first conveyance member 372 in a state where the second conveyance member 363 is separated from the continuous sheet S. Thereafter, the second conveyance member 363 comes into contact with the continuous sheet S, whereby the conveyance of the continuous sheet S is started by the second conveyance member 363 as well.

The detector 38 includes a sensor for detecting the conveyance status of the continuous sheet S. The detector 38 includes a contact sensor as illustrated in FIG. 2, for example.

Figure 2:
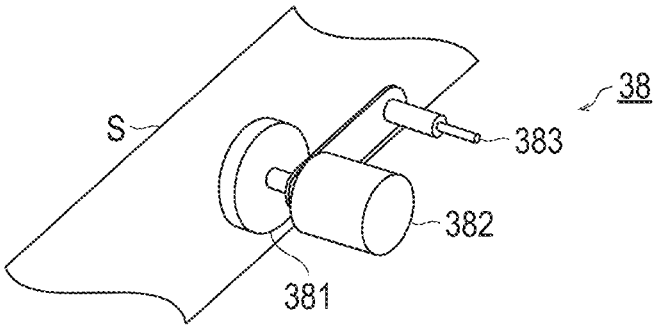
FIG. 2 is a diagram for explaining a contact sensor.

FIG. 2 is a diagram for explaining the contact sensor.

As illustrated in FIG. 2, the detector 38 includes a roller 381 and a rotary encoder 382 connected to the roller 381, for example. The roller 381 comes in contact with the continuous sheet S and rotates together with the conveyance of the continuous sheet S. The rotary encoder 382 is positioned by a fulcrum 383, and outputs a signal (pulse signal) every time it detects the rotation of the roller 381 by the predetermined angle, corresponding to the conveyance of the continuous sheet S by the predetermined distance. Therefore, the conveyance speed of the continuous sheet S can be detected on the basis of the signal output from the rotary encoder 382.

In addition, the detector 38 may include a non-contact sensor instead of the contact sensor as illustrated in FIG. 2 or in addition to the contact sensor. The detector 38 may include a laser Doppler sensor (speedometer) as a non-contact sensor, for example, and may read a registration mark (match mark) preliminarily formed on the continuous sheet S so as to directly detect the conveyance speed of the continuous sheet S.

The detector 38 is preferably disposed away from the fixer 37 including the first conveyance member 37 and disposed on the upstream side in the conveyance direction of the continuous sheet S with respect to the fixer 37. With this configuration, the detector 38 can detect a stable conveyance status of the continuous sheet S before the continuous sheet S is deprived of moisture by passing through the fixer 37 and contracts, and without being affected by the heat generated by the fixer 37. In the example illustrated in FIG. 1, the detector 38 is disposed outside the main body of the image forming apparatus 30. However, the detector 38 may be disposed apart from the fixer 37, and inside the main body of the image forming apparatus 30.

Note that the image forming system 1 and the image forming apparatus 30 may include components other than the components described above, or does not have to include some of the components described above.

Next, the flow of processing in the image forming apparatus 30 will be described. The processing of the image forming apparatus 30 determines, at an appropriate timing, whether the conveyance speed during printing of the continuous sheet S can be normally detected.

Figure 3:
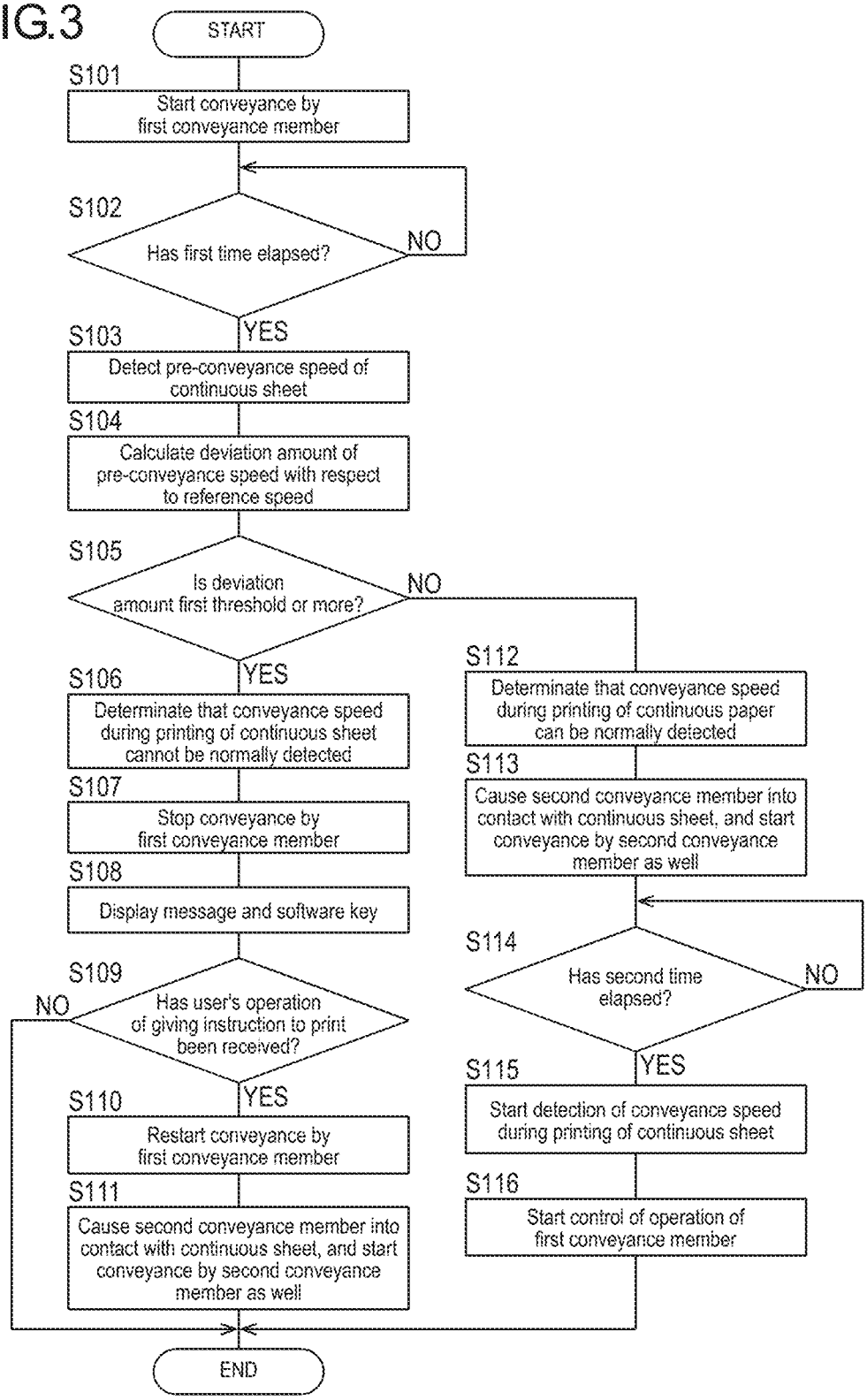
FIG. 3 is a flowchart illustrating a processing procedure of an image forming apparatus.
Figure 4:
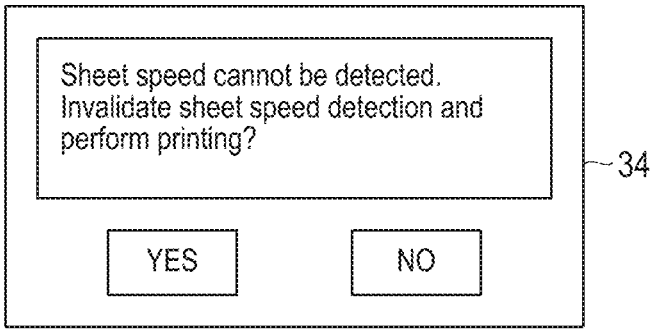
FIG. 4 is a diagram illustrating an example of a screen displayed on an operation panel.

FIG. 3 is a flowchart illustrating a processing procedure of the image forming apparatus. FIG. 4 is a diagram illustrating an example of a screen displayed on the operation panel. The processing algorithm illustrated in FIG. 3 is stored as a program in the storage 32 and performed by the controller 31.

As illustrated in FIG. 3, the controller 31 first causes the first conveyance member 372 coming in contact with the continuous sheet S to start conveyance of the continuous sheet S before the start of printing and in a state where the second conveyance member 363 is separated from the continuous sheet S (step S101). The controller 31 causes the first conveyance member 372 to start conveyance of the continuous sheet S without causing the second conveyance member 363 as the transfer roller to start conveyance of the continuous sheet S, that is, without causing the second conveyance member 363 to start transfer of an image to the continuous sheet S. The controller 31 causes the first conveyance member 372 to start conveyance of the continuous sheet S in cooperation with the controllers of the sheet feeder 10, the sheet feed adjustment device 20, the sheet discharge adjustment device 40, and the winding device 50.

Subsequently, the controller 31 determines in step S101 whether a predetermined first time has elapsed since the controller 31 caused the first conveyance member 372 to start conveyance of the continuous sheet S (step S102). The first time to set is the time necessary for the first conveyance member 372 to stabilize after start of the operation of the first conveyance member 372, for example, the time necessary for the operation of the driving motor that drives the first conveyance member 372, load fluctuation due to the contact of the first conveyance member 372, or the like, to stabilize.

In a case where the controller 31 determines that the first time has not elapsed (step S102: NO), the controller 31 waits until the first time has elapsed. In a case where the controller 31 determines that the first time has elapsed (step S102: YES), the controller 31 proceeds the processing to the processing of step S103.

Subsequently, the controller 31 causes the detector 38 to start detection, and detects the conveyance speed of the continuous sheet S conveyed by the first conveyance member 372 (hereinafter referred to as a "pre-conveyance speed" or a "first conveyance speed") on the basis of a detection result of the detector 38 (step S103). In a case where the detector 38 includes the rotary encoder 382 connected to the roller 381 as illustrated in FIG. 2, for example, the controller 31 detects the pre-conveyance speed of the continuous sheet S on the basis of the signal output from the rotary encoder 382. In addition, in a case where the detector 38 includes the laser Doppler sensor, for example, the controller 31 detects the pre-conveyance speed of the continuous sheet S on the basis of the detection result of the laser Doppler sensor.

Subsequently, the controller 31 calculates a deviation amount of the pre-conveyance speed with respect to the reference speed (step S104). Subsequently, the controller 31 determines whether the deviation amount is a predetermined first threshold or more (step S105). Here, the reference speed is an image forming speed in the image former 36, for example, which is a speed corresponding to the conveyance speed of the intermediate transfer belt 362, or the like. In addition, the deviation amount is calculated on the basis of the ratio of the pre-conveyance speed to the reference speed, for example, and the first threshold is set to 10%, for example, as a threshold for the ratio. Alternatively, the deviation amount may be calculated on the basis of a difference in the pre-conveyance speed with respect to the reference speed, and the first threshold may be set as a threshold for the difference.

The deviation amount of the pre-conveyance speed with respect to the reference speed can vary depending on the surface state of the continuous sheet S. The deviation amount increases in a case where the detector 38 includes the rotary encoder 382 connected to the roller 381 as a contact sensor, for example, as illustrated in FIG. 2, and when the roller 381 cannot rotate following the continuous sheet S which has a low friction coefficient or the continuous sheet S which has unevenness on the surface. In addition, the deviation amount increases in a case where the detector 38 includes the laser Doppler sensor, for example, and where the laser Doppler sensor cannot read the registration mark formed on the glossy continuous sheet S.

In a case where the controller 31 determines that the deviation amount is the first threshold or more (step S105: YES), proceeds the processing to the processing of step S106. The controller 31 determines that it is not possible to normally detect the conveyance speed (hereinafter also referred to as a "second conveyance speed") during printing of the continuous sheet S conveyed by both the first conveyance member 372 and the second conveyance member 363 (step S106). As described above, the first conveyance member 372 has the conveyance capability higher than that of the second conveyance member 363, and thus contributes more to conveyance of the continuous sheet S than the second conveyance member 363. Therefore, when the pre-conveyance speed of the continuous sheet S conveyed by the first conveyance member 372 is far from the reference speed, the controller 31 determines that the conveyance speed during printing of the continuous sheet S conveyed by both the first conveyance member 372 and the second conveyance member 363 will also be far from the reference speed and that the possibility that the conveyance speed during printing of the continuous sheet S cannot be normally detected is high.

Subsequently, the controller 31 causes the first conveyance member 372 to stop conveying the continuous sheet S (step S107). Subsequently, as illustrated in FIG. 4, for example, the controller 31 displays a message indicating that the conveyance speed (sheet speed) during printing of the continuous sheet S cannot be normally detected, software keys for receiving user's operation, or the like, on the operation panel 34 (step S108). Furthermore, in response to the displayed message, the controller 31 determines whether the operation panel 34 has received user's operation giving an instruction to invalidate the detection of the conveyance speed during printing of the continuous sheet S and print (step S109).

In a case where the controller 31 determines that the user's operation has been received, that is, the user's operation of selecting "Yes" has been received on the screen illustrated in FIG. 4, for example (step S109: YES), proceeds the processing to the processing step S110. Subsequently, the controller 31 causes the first conveyance member 372 to restart conveyance of the continuous sheet S (step S110). Furthermore, the controller 31 causes the second conveyance member 363 to come in contact with the continuous sheet S, and also causes the second conveyance member 363 to start conveyance of the continuous sheet S (step S111). With this configuration, the second conveyance member 363 as the transfer roller can transfer the image to the continuous sheet S, and printing is started in a state where detection of the conveyance speed during printing of the continuous sheet S is invalidated. Thereafter, the controller 31 finishes the processing.

In a case where the controller 31 determines that the user's operation has not been received, that is, the user's operation of selecting "NO" has been received on the screen illustrated in FIG. 4, for example (step S109: NO), finishes the processing with no additional operation.

In contrast, in a case where the controller 31 determines that the deviation amount is not the first threshold or more, that is, the deviation amount is less than the first threshold (step S105: NO), the controller 31 proceeds the processing to the processing of step S112. The controller 31 determines that the conveyance speed during printing of the continuous sheet S can be normally detected (step S112). When the pre-conveyance speed of the continuous sheet S conveyed by the first conveyance member 372 is close to the reference speed, the controller 31 determines that the conveyance speed during printing of the continuous sheet S conveyed by both the first conveyance member 372 and the second conveyance member 363 would also be close to the reference speed and that the possibility that the conveyance speed during printing of the continuous sheet S can be normally detected is high.

Subsequently, the controller 31 causes the second conveyance member 363 to come in contact with the continuous sheet S, and also causes the second conveyance member 363 to start conveyance of the continuous sheet S (step S113). That is, the controller 31 causes both the first conveyance member 372 and the second conveyance member 363 to start conveyance of the continuous sheet S. With this configuration, the second conveyance member 363 as a transfer roller can transfer an image onto the continuous sheet S, and printing is started.

Subsequently, the controller 31 determines whether a predetermined second time has elapsed since the controller 31 caused the second conveyance member 363 to start conveyance of the continuous sheet S in step S113 (step S114). The second time to set is the time necessary for the second conveyance member 363 to stabilize after start of the operation of the second conveyance member 363, for example, the time necessary for the operation of the driving motor that drives the second conveyance member 363, load fluctuation due to the contact of the second conveyance member 363, or the like, to stabilize.

In a case where the controller 31 determines that the second time has not elapsed (step S114: NO), the controller 31 waits until the second time has elapsed. In a case where the controller 31 determines that the second time has elapsed (step S114: YES), proceeds the processing to the processing of step S115.

Subsequently, the controller 31 starts detection of the conveyance speed during printing of the continuous sheet S on the basis of the detection result of the detector 38 (step S115). Subsequently, the controller 31 starts controlling the operation of the first conveyance member 372 based on the detected conveyance speed during printing of the continuous sheet S (step S116). More specifically, the controller 31 corrects the rotational speed of the first conveyance member 372 so as to reduce the deviation amount of the conveyance speed during printing of the continuous sheet S, with respect to the reference speed, for example. With this configuration, the controller 31 can maintain the conveyance speed during printing of the continuous sheet S at a constant level even in a case where the first conveyance member 372 is thermally expanded by heating and the outer diameter of the first conveyance member 372 has changed. Subsequently, the controller 31 finishes the processing.

The present embodiment has the following effects.

The image forming apparatus 30 determines whether the conveyance speed during printing of the continuous sheet S conveyed by the first conveyance member 372 and the second conveyance member 363 can be detected normally on the basis of the pre-conveyance speed which is the conveyance speed of the continuous sheet S conveyed by the first conveyance member 372. With this configuration, the image forming apparatus 30 can make the abovementioned determination before causing the second conveyance member 363 to start conveyance of the continuous sheet S, that is, at a timing before starting actual printing. Therefore, the image forming apparatus 30 can avoid a situation where control is performed in a state where the conveyance speed of the continuous sheet S is not normally detected during printing, and can suppress the occurrence of printing failure. In addition, the image forming apparatus 30 can also suppress the occurrence of printing waste such as waste of continuous sheet S and waste of toner, which can occur when it is determined that the conveyance speed of the continuous sheet S cannot be normally detected during printing. Furthermore, since the image forming apparatus 30 does not need to drive the second conveyance member 363, it is also possible to suppress occurrence of waste of the continuous sheet S that is conveyed as non-print conveyance as compared to the case where the abovementioned determination is made at a timing after the conveyance of the continuous sheet S is started by the second conveyance member 363.

In addition, the first conveyance member 372 is disposed on the downstream side of the second conveyance member 363 in the conveyance direction of the continuous sheet S. With this configuration, even when the second conveyance member 363 does not start conveyance of the continuous sheet S, the first conveyance member 372 can start conveyance of the continuous sheet S by starting to pull the continuous sheet S with high conveyance capability.

In addition, the first conveyance member 372 is disposed in the fixer 37 that fixes the image on the continuous sheet S, while the second conveyance member 363 is disposed in the secondary transfer region used to transfer the image onto the continuous sheet S. With this configuration, the image forming apparatus 30 can determine whether the conveyance speed during printing of the continuous sheet S can be normally detected before causing the second conveyance member 363 as the transfer roller to start conveyance of the continuous sheet S, that is, at a timing before starting actual printing.

In addition, the image forming apparatus 30 includes, for example, the detector 38 that outputs the signal every time the conveyance of the predetermined distance of the continuous sheet S is detected. The image forming apparatus 30 detects the conveyance speed (pre-conveyance speed and conveyance speed during printing) of the continuous sheet S on the basis of the signal output from the detector 38. With this configuration, the image forming apparatus 30 can accurately detect the conveyance speed of the continuous sheet S, for example, even in a case where an expensive sensor that directly detects the conveyance speed of the continuous sheet S is not provided.

In addition, the image forming apparatus 30 may include the detector 38 that directly detects the conveyance speed of the continuous sheet S. With this configuration, the image forming apparatus 30 can rapidly and accurately detect the conveyance speed of the continuous sheet S.

In addition, the detector 38 is arranged on the upstream side of the fixer 37 including the first conveyance member 372 in the conveyance direction of the continuous sheet S. With this configuration, the detector 38 can detect a stable conveyance status of the continuous sheet S before the continuous sheet S is deprived of moisture by passing through the fixer 37 and contracts.

In addition, the image forming apparatus 30 determines whether the deviation amount of the pre-conveyance speed of the continuous sheet S with respect to the reference speed is a predetermined first threshold or more. With this configuration, the image forming apparatus 30 can rapidly determine whether the conveyance speed during printing of the continuous sheet S can be normally detected on the basis of the deviation amount.

In addition, in a case where the image forming apparatus 30 determines that the conveyance speed during printing of the continuous sheet S cannot be normally detected, the image forming apparatus 30 causes the first conveyance member 372 to stop the conveyance of the continuous sheet S. The image forming apparatus 30 can suppress the waste of the continuous sheet S that is conveyed as non-print conveyance by rapidly stopping the conveyance of the continuous sheet S.

In addition, in a case where the image forming apparatus 30 determines that the conveyance speed during printing of the continuous sheet S cannot be normally detected, the image forming apparatus 30 displays the message. With this configuration, the image forming apparatus 30 can rapidly notify the user that the conveyance speed during printing of the continuous sheet S cannot be normally detected.

In addition, the image forming apparatus 30 is configured to be able to receive user's operation of giving the instruction to perform printing after invalidating the detection of the conveyance speed during printing of the continuous sheet S, in a case where the image forming apparatus 30 determines that the conveyance speed during printing of the continuous sheet S cannot be normally detected. With this configuration, the image forming apparatus 30 can start printing on the continuous sheet S for which the conveyance speed cannot be detected, making it possible to improve the convenience for the user. In addition, the image forming apparatus 30 can start printing even when some problem is occurring in the detector 38, making it possible to improve the convenience for the user.

In addition, the image forming apparatus 30 causes the second conveyance member 363 to separate from the continuous sheet S during detection of the pre-conveyance speed of the continuous sheet S, and in a case where determined that the conveyance speed during printing of the continuous sheet S can be normally detected, causes the second conveyance member 363 to come in contact with the continuous sheet S. With this configuration, the image forming apparatus 30 can control whether to control the second conveyance member 363 to convey the continuous sheet S.

In addition, in a case where the image forming apparatus 30 determines that the conveyance speed during printing of the continuous sheet S can be normally detected, the image forming apparatus 30 detects the conveyance speed during printing of the continuous sheet S after the predetermined second time has elapsed since the image forming apparatus 30 caused the second conveyance member 363 to start conveyance of the continuous sheet S. With this configuration, the image forming apparatus 30 can accurately detect the conveyance speed during printing of the continuous sheet S at the timing after the operation of the second conveyance member 363 is stabilized.

In addition, in a case where the image forming apparatus 30 determines that the conveyance speed during printing of the continuous sheet S can be normally detected, the image forming apparatus 30 controls operation of the first conveyance member 372 on the basis of the detected conveyance speed during printing of the continuous sheet S. With this configuration, the image forming apparatus 30 can maintain the conveyance speed during printing of the continuous sheet S at a constant level even in a case where the first conveyance member 372 is thermally expanded by heating, and occurrence of fluctuations in an image length on the continuous sheet S caused by fluctuations in the conveyance speed of the continuous sheet S can be suppressed.

Note that the present invention is not limited to the abovementioned modifications, and various alterations and improvement, or the like, can be implemented within the scope of the claims.

For example, the controller 31 may monitor conveyance abnormality of the continuous sheet S by, after starting printing, calculating the deviation amount of the conveyance speed during printing of the continuous sheet S with respect to the reference speed, and determining whether the deviation amount is the predetermined second threshold or more. In addition, the controller 31 may determine that the conveyance abnormality of the continuous sheet S is occurring in a case where the deviation amount is determined as the second threshold or more, and may determine that the conveyance abnormality of the continuous sheet S is not occurring in a case where the deviation amount is determined as less than the second threshold. With this configuration, the controller 31 can accurately determine whether the conveyance abnormality of the continuous sheet S due to the breakage of the continuous sheet S, the adhesion of foreign matter to the continuous sheet S, or the like, on the basis of the detected conveyance speed during printing of the continuous sheet S, is occurring or not. Note that the controller 31 may cause the first conveyance member 372 and the second conveyance member 363 to stop the conveyance of the continuous sheet S in a case where the controller 31 has determined that the conveyance abnormality of the continuous sheet S is occurring.

Note that it is preferable that the second threshold be set to a value smaller than the abovementioned first threshold. For example, the first threshold may be set to 10%, and the second threshold may be set to 5%. The conveyance speed during printing of the continuous sheet S is preferably as close as possible to the reference speed corresponding to the image forming speed. Meanwhile, the pre-conveyance speed of the continuous sheet S is a conveyance speed of the continuous sheet S for which the second conveyance member 363 does not contribute to conveyance, and is different from the conveyance speed during printing of the continuous sheet S. Therefore, the second threshold applied to the conveyance speed during printing of the continuous sheet S is preferably smaller than the first threshold applied to the pre-conveyance speed of the continuous sheet S for which the second conveyance member 363 does not contribute to the conveyance.

Moreover, the abovementioned embodiment has described an exemplary case where the controller 31 makes determination of whether it is possible to normally detect the conveyance speed during printing of the continuous sheet S on the basis of the pre-conveyance speed of the continuous sheet S after the predetermined first time has elapsed. However, the present embodiment is not limited to this. The controller 31 may set the first threshold to a large value to a degree capable of making the abovementioned determination accurately even on the basis of the pre-conveyance speed of the continuous sheet S immediately after causing the first conveyance member 372 to start conveyance of the continuous sheet S, and may omit the processing of step S102. With this configuration, the controller 31 can reduce the processing time.

Moreover, the abovementioned embodiment has described an exemplary case where the detector 38 includes the rotary encoder 382 connected to the roller 381 and the controller 31 detects the pre-conveyance speed of the continuous sheet S on the basis of the signal output from the rotary encoder 382. However, the present embodiment is not limited to this. The controller 31 may detect the time necessary for the roller 381 to make one rotation on the basis of the signal output from the rotary encoder 382, and may make a determination regarding the deviation amount of the detected time with respect to the reference time, instead of determination regarding the deviation amount of the pre-conveyance speed with respect to the reference speed.

Moreover, the abovementioned embodiment has described an exemplary case where the controller 31 makes determination of whether it is possible to normally detect the conveyance speed during printing of the continuous sheet S on the basis of the pre-conveyance speed of the continuous sheet S and thereafter printing is started with no additional operation. However, the present embodiment is not limited to this. The controller 31 may control to start printing after causing the first conveyance member 372 or the like to convey the continuous sheet S that has been conveyed as non-print conveyance before the start of printing in a direction opposite to the normal conveyance direction, and return the continuous sheet S to an initial position.

Moreover, the processing related to the abovementioned embodiments may include steps other than the abovementioned steps, or does not have to include some steps among the abovementioned steps. Moreover, the order of the steps is not limited to the abovementioned embodiment. Furthermore, each of steps may be combined with another step and performed as a single step, or may be incorporated in another step and performed, or divided into a plurality of steps and performed.

Moreover, units and methods used for performing various types of processing in the image forming apparatus 30 according to the abovementioned embodiments can be implemented by any of a dedicated hardware circuit or a programmed computer. The abovementioned program may be provided, for example, by a computer-readable recording medium such as a CD-ROM (Compact Disc Read Only Memory), or may be provided online via a network such as the Internet. In this case, the program recorded on the computer-readable recording medium is typically transferred to and stored in storage unit such as a hard disk. Moreover, the abovementioned program may be provided as single application software, or may be incorporated into the software as one function of the image forming apparatus 30.

Although embodiments of the present invention have been described and illustrated in detail, the disclosed embodiments are made for purpose of illustration and example only and not limitation. The scope of the present invention should be interpreted by terms of the appended claims.

What is claimed is:

1. An image forming apparatus comprising:

a first conveyance member and a second conveyance member that convey a continuous sheet; and a controller that determines whether it is possible to normally detect a second conveyance speed which is a conveyance speed of said continuous sheet conveyed by said first conveyance member and said second conveyance member on the basis of a first conveyance speed which is a conveyance speed of said continuous sheet conveyed by said first conveyance member prior to conveying the continuous sheet by the first conveyance member and the second conveyance member together.

2. The image forming apparatus according to claim 1, wherein said first conveyance member is disposed on a downstream side of said second conveyance member in a conveyance direction of said continuous sheet.

3. The image forming apparatus according to claim 1, wherein said first conveyance member is disposed in a fixer which fixes an image on said continuous sheet, and said second conveyance member is disposed in a secondary transfer region used to transfer an image onto said continuous sheet.

4. The image forming apparatus according to claim 1, further comprising a detector which outputs a signal every time conveyance of a predetermined distance of said continuous sheet is detected, wherein said controller detects a conveyance speed of said continuous sheet on the basis of the signal output from said detector.

5. The image forming apparatus according to claim 4, wherein said detector is disposed on an upstream side of said first conveyance member in a conveyance direction of said continuous sheet.

6. The image forming apparatus according to claim 1, further comprising a detector which detects a conveyance speed of said continuous sheet, wherein said controller detects a conveyance speed of said continuous sheet on the basis of a detection result of said detector.

7. The image forming apparatus according to claim 1, wherein said controller determines whether a deviation amount of said first conveyance speed with respect to a reference speed is a predetermined first threshold or more, and determines that said second conveyance speed cannot be normally detected in a case where said controller has determined that a deviation amount of said first conveyance speed is said first threshold or more, and determines that said second conveyance speed can be normally detected in a case where said controller has determined that a deviation amount of said first conveyance speed is less than said first threshold.

8. The image forming apparatus according to claim 7, wherein said controller further determines whether a deviation amount of said second conveyance speed with respect to said reference speed is a predetermined second threshold or more, and further determines that a conveyance abnormality of said continuous sheet is occurring in a case where said controller has determined that the deviation amount of said second conveyance speed is said second threshold or more, and further determines that the conveyance abnormality of said continuous sheet is not occurring in a case where said controller has determined that the deviation amount of said second conveyance speed is less than said second threshold, and said second threshold is set to be smaller than said first threshold.

9. The image forming apparatus according to claim 1, wherein, in a case where said controller has determined that said second conveyance speed cannot be normally detected, said controller causes said first conveyance member to stop conveyance of said continuous sheet.

10. The image forming apparatus according to claim 1, further comprising a display that displays a message indicating that said second conveyance speed cannot be normally detected in a case where said controller has determined that said second conveyance speed cannot be normally detected.

11. The image forming apparatus according to claim 1, further comprising an operation receiver capable of receiving user's operation of giving an instruction to perform invalidating detection of said second conveyance speed and printing in a case where said controller has determined that said second conveyance speed cannot be normally detected.

12. The image forming apparatus according to claim 1, wherein, said controller causes said second conveyance member to separate from said continuous sheet during detection of said first conveyance speed, and in a case where said controller has determined that said second conveyance speed can be normally detected, said controller causes said second conveyance member to come in contact with said continuous sheet.

13. The image forming apparatus according to claim 1, wherein, in a case where said controller has determined that said second conveyance speed can be normally detected, said controller detects said second conveyance speed after a predetermined time has elapsed since said controller caused said second conveyance member to start conveyance of said continuous sheet.

14. The image forming apparatus according to claim 1, wherein, in a case where said controller has determined that said second conveyance speed can be normally detected, said controller controls operation of said first conveyance member on the basis of said detected second conveyance speed.

15. A non-transitory computer-readable storage medium storing a control program for an image forming apparatus including a first conveyance member and a second conveyance member which convey a continuous sheet, the control program causing a computer to perform:

detecting a first conveyance speed which is a conveyance speed of said continuous sheet conveyed by said first conveyance member; and determining whether a second conveyance speed which is a conveyance speed of said continuous sheet conveyed by said first conveyance member and said second conveyance member can be normally detected on the basis of said first conveyance speed prior to conveying the continuous sheet by the first conveyance member and the second conveyance member together.

* * * * *